United States Patent [19]

Hess et al.

[11] Patent Number: 4,574,221

[45] Date of Patent: Mar. 4, 1986

[54] IGNITION CONTROL INTEGRATED CIRCUIT HAVING SUBSTRATE INJECTION PREVENTING MEANS

[75] Inventors: Robert M. Hess, Roselle, Ill.; Robert B. Jarrett, Tempe, Ariz.

[73] Assignee: Motorola, Inc., Schaumburg, Ill.

[21] Appl. No.: 567,973

[22] Filed: Jan. 4, 1984

[51] Int. Cl.[4] ..... H05B 37/00

[52] U.S. Cl. ..... 315/209 T; 307/200 A; 307/300; 307/443; 315/200 R; 315/209 R

[58] Field of Search ..... 307/200 A, 300, 443; 315/209 T, 200 R, 209 R

[56] References Cited

U.S. PATENT DOCUMENTS

| | | | |
|---|---|---|---|
| 3,307,044 | 2/1967 | Furukawa et al. | 307/88.5 |
| 3,469,173 | 9/1969 | Ohashi et al. | 321/44 |
| 3,553,486 | 1/1971 | Dow | 307/213 |
| 3,882,840 | 5/1975 | Adamian | 123/148 |
| 4,236,088 | 11/1980 | Horiuchi et al. | 307/240 |
| 4,291,319 | 9/1981 | Carinalli | 357/13 |
| 4,347,827 | 9/1982 | LoCascio | 123/618 |
| 4,359,038 | 11/1982 | Xiberas | 315/209 T |
| 4,461,979 | 7/1984 | Jeenicke et al. | 307/300 |
| 4,471,237 | 9/1984 | Kaplan | 307/443 |

*Primary Examiner*—Harold Dixon
*Attorney, Agent, or Firm*—Phillip H. Melamed

[57] ABSTRACT

There is disclosed an ignition control circuit of the type which facilitates the storage of energy in an external inductive load during a dwell period and the release of the stored energy from the inductive load through a spark gap at the end of the dwell period. The circuit includes switch means for conducting current through the inductive load during the dwell period, and an integrated circuit for turning the switch means on during the dwell period and off at the end of the dwell period. The integrated circuit includes an output transistor for controlling the switch means, a current source for driving the output transistor, and control means for enabling the current source during the dwell period and disabling the current source at the end of the dwell period.

19 Claims, 2 Drawing Figures

IGNITION CONTROL INTEGRATED CIRCUIT HAVING SUBSTRATE INJECTION PREVENTING MEANS

FIELD OF THE INVENTION

The present invention generally relates to integrated circuits which facilitate the storage of energy in and release of energy from external capacitive or inductive loads. The present invention more particularly relates to an ignition control integrated circuit having an output transistor for controlling the storage of energy and release of the stored energy and means for preventing integrated circuit substrate injection which otherwise can occur due to large negative transient voltages developed during the release of the stored energy.

BACKGROUND OF THE INVENTION

There are many applications wherein it is necessary to store energy in capacitive or inductive loads and then release the stored energy quickly. One such application is in the ignition system of an internal combustion engine. Here, energy is stored in an ignition coil during a dwell period. At the end of the dwell period the stored energy is quickly released or discharged across a spark gap of a spark plug. To control the storage and release of the energy, ignition control circuits are provided. To reduce the size and cost of these circuits, ignition control circuits are generally provided in integrated circuit form and include an output transistor which controls an external power switch, such as a power transistor or transistors, which are disposed in series with the primary of the ignition coil between a voltage source and ground potential.

During the dwell period, the ignition circuit output transistor turns the power switch on to permit current flow through the ignition coil primary. At the end of the dwell period, the output transistor turns the power switch off to cause the stored energy to be released across the spark gap through the ignition coil secondary. During the release of the stored energy, the spark extinguishes before all of the stored energy is totally released. The residual stored energy therefore creates a large negative voltage across the ignition coil primary which can be propagated back to the output transistor. When this occurs, the output transistor can be inadvertently forward biased into saturation pulling the emitter and collector thereof down to below ground potential. If the output transistor is formed on the integrated circuit, and is isolated from the other components thereof by, for example, a grounded p-type substrate and isolation layers, then the negative potential on the collector can cause integrated circuit substrate injection by forward biasing the junction between the isolation and the collector. This in essence removes the isolation between the integrated circuit components and adversely effects its operation.

To overcome this problem in the prior art, the output transistor has been formed to be a large PNP transistor. While this has generally solved the problem, these PNP output transistors are made large and thus take up valuable integrated circuit area. Another attempt has been to leave the output transistor off of the integrated circuit and thereby make it an external component. However, this adds to part count which increases the cost of such a system. In summary, there is a need in the art for an ignition control integrated circuit which both includes the output transistor on the integrated circuit and which includes means for preventing substrate injection without resorting to large internal PNP transistors.

It is therefore a general object of the present invention to provide an integrated circuit adapted to facilitate storage of energy in and the release of energy from external capacitive or inductive loads which includes means for preventing substrate injection within the integrated circuit during the release of the stored energy.

It is a more particular object of the present invention to provide an ignition control integrated circuit including an output transistor which controls the storage of energy in and the release of energy from an inductive load and which includes means for preventing current flow through the base of the output transistor during the release of the stored energy.

It is a further object of the present invention to provide such an integrated circuit wherein the output transistor is an NPN transistor.

SUMMARY OF THE INVENTION

The present invention therefore provides a substrate injection preventing means for use in an integrated circuit of the type having a semiconductor substrate and adapted to facilitate storage of energy in and the release of energy from external capacitive or inductive loads resulting in transient voltages within the integrated circuit during the release of the stored energy and wherein the integrated circuit includes an output transistor having a base, an emitter, and a collector for controlling the storage and release of the energy. The substrate injection preventing means precludes the injection of current from the substrate into at least the output transistor notwithstanding the transient voltages and includes control means for preventing current flow through the base of the output transistor during the release of the stored energy.

The present invention more particularly provides an ignition control circuit of the type which facilitates the storage of energy in an external inductive load during a dwell period and the release of the stored energy from the inductive load through a spark gap at the end of the dwell period. The circuit includes switch means for conducting current through the inductive load during the dwell period, and an integrated circuit for turning the switch means on during the dwell period and off at the end of the dwell period. The integrated circuit includes an output transistor for controlling the switch means, a current source for driving the output transistor, and control means for enabling the current source during the dwell period and disabling the current source at the end of the dwell period.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, in the several figures of which like reference numerals identify identical elements, and wherein:

DESCRIPTION OF THE PREFERRED EMBODIMENT

Figure 1:
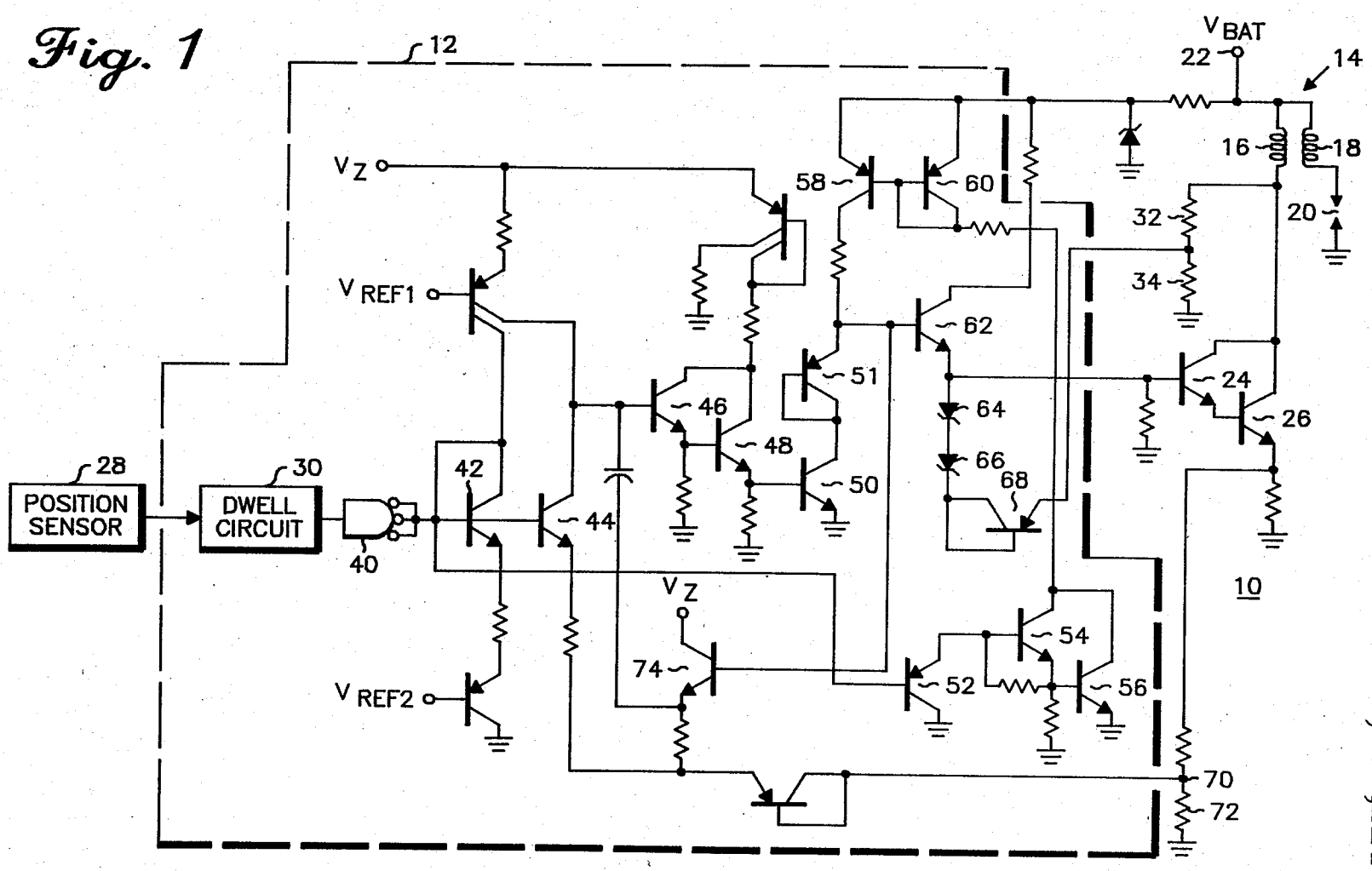
FIG. 1 is a schematic circuit diagram of an ignition control system which includes an ignition control integrated circuit embodying the present invention.

Referring now to FIG. 1, it illustrates an ignition control system 10 which includes an ignition control integrated circuit 12 embodying the present invention. The system components external to the integrated circuit 12 generally include an ignition coil 14 having a primary 16 and a secondary 18. The secondary 18 is coupled in series with a spark gap 20 between a voltage source terminal 22 and ground potential. The primary 16 is coupled in series with a switch means comprising Darlington pair transistors 24 and 26 between the power supply terminal 22 and ground potential. A crankshaft position sensor 28 is coupled to a dwell circuit 30 of the integrated circuit 12 and provides the dwell circuit 30 with a reference signal indicating the position of the crankshaft of the internal combustion engine.

In summary, the integrated circuit 12 after being provided with a reference signal from the position sensor 28 initiates a dwell period during which time the Darlington pair transistors 24 and 26 are turned on to permit current flow through the primary 16 of the ignition coil 14 to store energy in the ignition coil primary. At the end of the dwell period, the Darlington pair transistors 24 and 26 are turned off causing the energy stored in the primary 16 to be inductively coupled to the secondary 18 and discharged to ground potential through the spark gap 20. During the release of the stored energy, a large positive voltage transient occurs across the primary 16 of the ignition coil 14 which is sensed by the voltage divider including resistors 32 and 34 and which is coupled to the integrated circuit in a manner to be described hereinafter. More importantly with respect to the present invention, during the release of the stored energy from the ignition coil 14, the spark across the spark gap 20 will extinguish even though stored energy remains in the ignition coil 14. This residual energy, during the release thereof, will cause a relatively large negative voltage across the primary 16 which can be propagated through the Darlington pair transistors 24 and 26 into the integrated circuit 12. It is the deleterious effects of this potentially propagated negative voltage transient that the present invention prevents.

Now that the overall operation of the system has been described, a more detailed description of the operation of the integrated circuit 12 will now be given. At the beginning of the dwell period, the dwell circuit 30 will provide a signal to a gate 40 which in turn provides a control signal to the bases of transistors 42 and 44 to forward bias and to turn on transistors 42 and 44. Since transistor 44 is on, the Darlington pair transistors 46 and 48 will be off and transistor 50 will also be off.

The control signal which forward biases transistors 42 and 44 will also back bias transistor 52. Since transistor 52 is back biased, the Darlington pair transistors 54 and 56 will conduct. Transistors 54 and 56 comprise control means for enabling and disabling a current source comprising current mirror transistors 58 and 60. As can be noted from the drawing, the transistors 58 and 60 are PNP transistors having their emitters coupled to the power source terminal 22, their bases coupled together, and the collector of transistor 60 coupled to the collectors of the Darlington pair transistors 54 and 56. As a result, when the Darlington pair transistors 54 and 56 conduct, they enable the current source transistors 58 and 60 to conduct also. Positive potential for the transistors 42 and 44 is provided at an internal reference potential terminal $V_Z$, and reference potentials are provided at the terminals $V_{REF1}$ and $V_{REF2}$.

With transistor 50 off and transistor 58 conducting, current from transistor 58 cannot flow through diode 51 and will flow into the base of output transistor 62. The output transistor 62 comprises an NPN transistor having its collector coupled to the power supply terminal 22 and its emitter coupled through diodes 64, 66, and 68 to the positive voltage transient divider comprising resistors 32 and 34.

With transistor 62 conducting, it will forward bias the Darlington pair transistors 24 and 26 to turn the Darlington pair transistors on to enable current flow through the ignition coil primary 16.

In a short period of time, the current through the primary 16 will reach a limit which is sensed at point 70. The voltage across resistor 72 is used to control the bias of transistor 44 to cause transistor 44 to go into a linear mode. As a result, transistors 46 and 48, and transistor 50 will partially turn on to decrease the drive at the base of output transistor 62. This closed loop thereby formed limits the conduction of output transistor 62. As a result, the current conduction through the Darlington pair transistors 24 and 26 is maintained at a current limit until the end of the dwell period is reached.

At the end of the dwell period, the control signal at the base of transistors 42 and 44 goes low to turn transistors 42 and 44 off. This in turn turns transistors 46, 48, and 50 on. Output transistor 62 will then be turned off and thus, it will turn off the Darlington pair transistors 24 and 26. With the Darlington pair transistors 24 and 26 turned off, the energy stored in the primary 16 of the ignition coil 14 will be released through the secondary 18 and discharged across the spark gap 20.

As previously explained, the spark across gap 20 will be extinguished before all of the stored energy is released. This creates a negative voltage transient at the collectors of the Darlington pair transistors 24 and 26. The negative transient voltage can be sufficient to forward bias the collector base junctions of the Darlington pair transistors 24 and 26 so that the emitter of output transistor 62 will be pulled below ground potential. If not prevented, this could result in forward biasing the base-emitter junction of output transistor 62 and saturate the transistor to thus pull the collector of transistor 62 below ground potential. If this condition were allowed to occur, substrate injection within the integrated circuit would occur.

Figure 2:
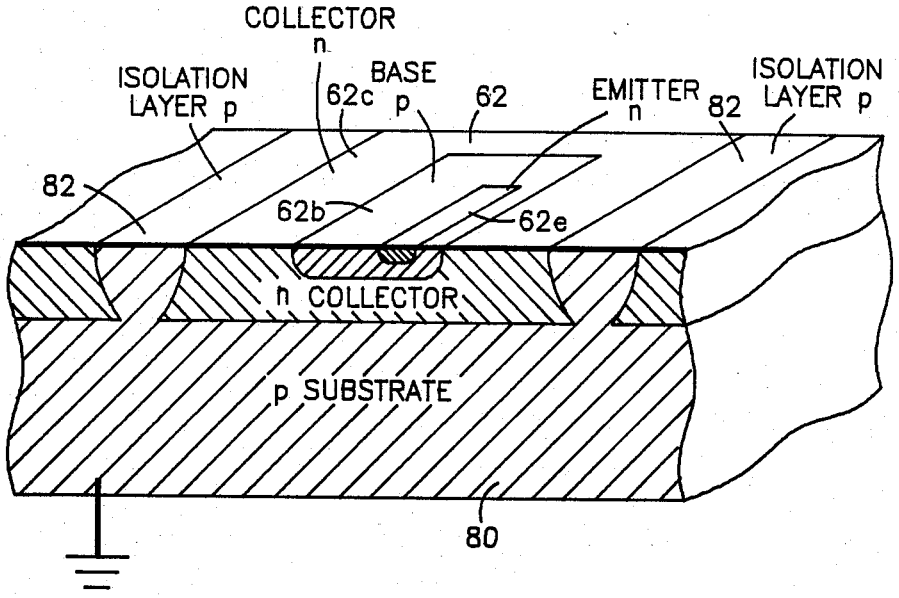
FIG. 2 is a partial perspective view of the output transistor of the ignition control integrated circuit illustrated in FIG. 1.

Referring now momentarily to FIG. 2, it shows a partial perspective view of the integrated circuit and more particularly, the detailed configuration of the output transistor 62. The integrated circuit is formed on a substrate 80 which is p-type. The transistor 62 includes an n-type collector 62*c*, a p-type base 62*b*, and an n-type emitter 62*e*. The transistor 62 is isolated from the other integrated circuit components by the p-type substrate 80 and p-type isolation layers 82. Integrated circuits of this type are generally operated with their substrates grounded as indicated. The isolation layer and the substrate form a PN junction between the collector of transistor 62 and the substrate and isolation layer. As long as the collector is positive with respect to these regions, that diode is back biased and the transistor 62 is isolated from the other components on the integrated circuit. However, should the collector 62c be pulled to below ground potential, the diode junction between the collector and the isolation layer and substrate will be forward biased to cause current flow from the substrate into the collector of transistor 62. This is known as integrated circuit substrate injection and is to be avoided. Substrate injection can cause malfunctioning of the overall integrated circuit.

In accordance with the present invention, the substrate injection is precluded by the control means comprising the Darlington transistors 54 and 56 and the current mirror comprising transistors 58 and 60.

As can be noted in FIG. 1, at the end of the dwell period, the control signal which back biases transistors 42 and 44 will also forward bias transistor 52. With transistor 52 being forward biased, the control means transistors 54 and 56 will turn off. When transistors 54 and 56 turn off, they will also turn off transistor 60. When transistor 60 is turned off, transistor 58 will also be turned off. This effectively isolates the base of transistor 62 from the power supply terminal 22. As a result, the flow of current through the transistor 62 will be prevented because there is no source of base current to the base of transistor 62. As a result, even should a negative voltage transient appear at the emitter of output transistor 62, since there is no source of base current effectively coupled to its base, transistor 62 cannot saturate and thereby pull its collector to below ground potential. As a result, the collector of output transistor 62 will always be positive with respect to the p-type substrate and isolation layers of the integrated circuit to the end that integrated circuit substrate injection is avoided notwithstanding the occurrence of negative voltage transients at the emitter of the output transistor 62.

It should be noted that during such negative transients at the emitter of transistor 62, transistor 50 is on while transistor 58 is off. During this time, the diode 51 prevents the base of transistor 62 from obtaining any base current from ground potential while the off transistor 58 prevents the base of transistor 62 from obtaining any base current from the positive voltage source terminal 22.

As can be appreciated from the foregoing, the integrated circuit substrate injection is prevented without locating the output transistor 62 external to the integrated circuit. Hence, the increased part count and cost associated with such a solution is avoided. Additionally, the integrated circuit substrate injection has also been prevented without making the output transistor 62 a PNP transistor which is commonly large in size compared to NPN transistors. As a result, integrated circuit area is preserved.

What is claimed is:

1. An integrated circuit of the type having a semiconductor substrate and adapted to facilitate the storage of energy in and the release of energy from external capacitive or inductive loads resulting in transient voltages within said integrated circuit during the release of said stored energy and wherein said integrated circuit includes an output transistor having a base, an emitter, and a collector, signals at one of said emitter and collector used for controlling the storage and release of said energy, conduction of said output transistor being controller by a driver stage coupled to the base of said output transistor and providing drive signals thereto, the improvement comprising substrate injection preventing means for precluding the injection of current from said substrate into at least said output transistor notwithstanding said transient voltages, said substrtate injection preventing means comprising control means in said integrated circuit and separate from said driver stage for preventing current flow through said base of said output transistor during the release of said stored energy and despite said transient voltages, thereby preventing substrate injection.

2. An integrated circuit as defined in claim 1 wherein said driver stage includes a current source coupled to said base of said output transistor for sourcing current into said base of said output transistor during the storage of said energy, said driver stage also including a driver transistor having an output electrode coupled separately from said current source to said output transistor base, signals at said driver transistor output electrode controlling conduction of said output transistor, and wherein said control means is arranged for disabling said current source during the release of said stored energy.

3. The integrated circuit as defined in claim 2 wherein said current source comprises a pair of transistors forming a current mirror, one of said current mirror transistors being coupled to said output transistor base, and the other said current mirror transistor being coupled to said control means.

4. An integrated circuit as defined in claim 3 wherein each said current mirror transistor includes a base, an emitter, and a collector, wherein said emitters are coupled to a common voltage source, wherein said bases are coupled together, wherein one of said collectors is coupled to said output transistor base, and wherein the other said collector is coupled to said control means.

5. An integrated circuit as defined in claim 4 wherein said control means includes a transistor having an emitter coupled to ground potential, a collector coupled to said other said collector and a base coupled to said driver stage for receiving switching signals therefrom.

6. An integrated circuit as defined in claim 4 wherein said current mirror transistors are PNP transistors.

7. An integrated circuit as defined in claim 5 wherein said control means transistor is an NPN transistor.

8. An integrated circuit as defined in claim 2 further including an input for receiving a control signal for initiating the release of said stored energy, and wherein said control means is coupled to said input for disabling said current source responsive to said control signal.

9. An integrated circuit as defined in claim 2 wherein said control means is also arranged for enabling said current source during the storing of said stored energy.

10. An ignition control circuit of the type which facilitates the storage of energy in an external inductive load during a dwell period and the release of said stored energy from said inductive load through a spark gap at the end of said dwell period, said circuit comprising:

switch means for conducting current through said inductive load during said dwell period; and an integrated circuit for turning said switch means on during said dwell period and off at the end of said dwell period, said integrated circuit including an output transistor having a base, an emitter and a collector, signals at one of said emitter and collector used for controlling said switch means such that when said output transistor conducts said switch is closed and energy is stored in said load, a current source and a driver stage each coupled to said output transistor base for driving said output transistor, and control means for preventing injection of substrate current into said output transistor notwithstanding transient voltages caused during said release of stored energy, said control means, being separate from said driver stage and enabling said current source during said dwell period and disabling said current source and preventing current flow through said base of said output transistor at the end of said dwell period and thereby preventing turning on of said output transistor despite said transient voltages.

11. A circuit as defined in claim 10 wherein said output transistor emitter is coupled to said switch means, said collector is coupled to a voltage source, and said base is coupled to said current source, said driver stage including a driver transistor having an output electrode coupled separately from current source to said output transistor base.

12. A circuit as defined in claim 10 wherein said current source includes a pair of transistors forming a current mirror, one of said current mirror transistor having an output electrode coupled to said output transistor base and the other said current mirror transistor having a base electrode coupled to said control means.

13. A circuit as defined in claim 10 further including an input for receiving a dwell period control signal, and wherein said output transistor is responsive to said dwell period control signal for turning said switch means on during said dwell period and off at the end of said dwell period, and wherein said control means is also responsive to said dwell period control signal for enabling said current source only during said dwell period.

14. A circuit as defined in claim 12 wherein said control means includes a transistor having an emitter coupled to ground potential, a collector coupled to said base electrode of said other current mirror transistor and a base coupled to said driver stage for receiving switching signals therefrom.

15. A circuit as defined in claim 14 wherein said current mirror transistors are PNP transistors.

16. A circuit as defined in claim 14 wherein said control means transistor is an NPN transistor.

17. An integrated circuit as defined in claim 1 wherein said output transistor emitter is coupled to said load for controlling the storage and release of energy therein, and wherein said control means prevents turning on of said output transistor due to transient voltages at said emitter, thereby preventing said output transistor collector from following the transient voltages and causing substrate injection.

18. An integrated circuit as defined in claim 2 wherein said output transistor emitter is coupled to said load for controlling the storage and release of energy therein, and wherein said control means prevents turning on of said output transistor due to transient voltages at said emitter, thereby preventing said output transistor collector from following the transient voltages and causing substrate injection.

19. An integrated circuit as defined in claim 6 wherein said output transistor emitter is coupled to said load for controlling the storage and release of energy therein, and wherein said control means prevents turning on of said output transistor due to transient voltages at said emitter, thereby preventing said output transistor collector from following the transient voltages and causing substrate injection.

* * * * *